US006614340B2

(12) United States Patent
Handcock et al.

(10) Patent No.: US 6,614,340 B2
(45) Date of Patent: Sep. 2, 2003

(54) FULL-RANGE HIGH VOLTAGE CURRENT LIMITING FUSE

(75) Inventors: Harold John Handcock, Kinoulton (GB); Mark Paul Judson, Bilsthorpe (GB)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 10/073,403

(22) Filed: Feb. 11, 2002

(65) Prior Publication Data

US 2002/0109574 A1 Aug. 15, 2002

(30) Foreign Application Priority Data

Feb. 13, 2001 (GB) ..... 0103541

(51) Int. Cl.[7] ..... H01H 85/12; H01H 85/38

(52) U.S. Cl. ..... 337/292; 337/293; 337/162; 337/290; 337/297

(58) Field of Search ..... 337/292, 293, 337/273, 281, 282, 290, 297, 159, 161, 162, 164

(56) References Cited

U.S. PATENT DOCUMENTS 3,287,525 A * 11/1966 Mikulecky ..... 337/161
3,735,317 A * 5/1973 Jacobs, Jr. ..... 337/291
4,210,892 A * 7/1980 Salzer ..... 337/161
4,308,514 A * 12/1981 Kozacka ..... 337/159
5,355,111 A * 10/1994 Haasler et al. ..... 337/248

FOREIGN PATENT DOCUMENTS

GB 2126808 A * 3/1984 ..... H01H/85/04
GB 2184301 A 6/1987
HU 216852 B 5/1997

* cited by examiner

*Primary Examiner*—Anatoly Vortman
(74) *Attorney, Agent, or Firm*—Armstrong Teasdale LLP

(57) ABSTRACT

A Full-Range fuse element assembly includes an insulative former having opposite first and second ends and electrically conducting connectors coupled to ends of the former. A plurality of fuse elements extend between the first connector and the second connector about the insulative former, and each of the fuse elements include a low current interrupting fuse element portion extending from the first connector and a high current limiting fuse element portion extending from the second connector. An insulative sleeve surrounds each of the low current interrupting fuse element portions, and each sleeve includes an end adjacent a respective one of the high current limiting fuse element portions. Each of the low current interrupting fuse element portions includes a weak spot located proximate the second end of a respective one of the sleeves.

13 Claims, 1 Drawing Sheet

FULL-RANGE HIGH VOLTAGE CURRENT LIMITING FUSE

This application claims the benefit of United Kingdom Patent Application Number 0103541.9, filed Feb. 13, 2001.

BACKGROUND OF THE INVENTION

This invention relates generally to fuse element or fuse link assemblies, and, more particularly, to fuse element assemblies for General Purpose or Full-Range fuses.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined limit, the fusible elements melt and opens one or more circuit through the fuses to prevent electrical component damage.

General Purpose or Full-Range type high voltage, current-limiting fuses are operable to safely interrupt both relatively high fault currents and relatively low fault currents with equal effectiveness. At least one type of General Purpose or Full-Range type fuses employs a fuse element assembly having two distinct portions. One portion is configured for opening of an electrical circuit under relatively low fault current conditions and a second portion is configured for opening of an electrical circuit under relatively high fault current conditions. The first portion includes a plurality of fuse elements contained in respective insulating sleeves and including a weak spot and/or low melting alloy spot located approximately at the center or midpoint of each of the fuse elements. The second portion includes a plurality of fuse elements fabricated from a high conductivity metal and connected in parallel with one another. The first and second fuse element portions are serially wound onto an insulating former and embedded in a arc-extinguishing material within a fuse body.

Under high fault current conditions, the second portion of the fuse element assembly partially vaporizes, and the arc extinguishing material absorbs energy and attains a high electrical resistance to safely and effectively interrupt current through the fuse. Under low fault current conditions, the first portion of the fuse element assembly interrupts current by melting of a fuse element within one or more of the insulated sleeves. The resultant arc within the sleeves generates ionized gas which is expelled from the open ends of the sleeves.

In elevated voltage and current applications, however, such as for protection of increasingly common 12 kV transformers with ratings as high as 1000 kVA, conventional Full-Range fuses have been found deficient. As current ratings and voltage ratings of Full-Range fuses are increased, the fuse is prone to undesirable internal and external damage from resultant increased energy of ionized gas blasts in operation of the fuse. While reinforcement of the insulating sleeves of the first portion of the fuse element assembly is of some use in producing higher current ratings and voltage ratings of Full-Range fuses, reinforcement of the sleeves tends to complicate assembly and increase manufacturing costs of the fuses without overcoming problematic excessive ionized gas blasts and resultant damage during operation of the fuse.

In addition, while voltage and current ratings of Full-Range fuses may be increased by using fuse elements and fuse constructions of greater cross sectional area and capacity, this increases the physical size of the Full-Range fuse. Especially when a large number of fuses are employed, increasing the size of the fuses is problematic.

BRIEF SUMMARY OF THE INVENTION

In an exemplary embodiment of the invention, a fuse element assembly for a Full-Range fuse includes an insulative former having opposite first and second ends. A first electrically conducting connector is coupled to the first end of the former and a second electrically conducting connector is coupled to the second end of the former. At least one fuse element extends between the first connector and the second connector about the insulative former. The fuse element includes a low current interrupting fuse element portion extending from the first connector, a high current limiting fuse element portion extending from the second connector, and the low current interrupting fuse element portion and the high current limiting fuse element portion coupled to one another intermediate the first and second connector. An insulative sleeve surrounds the low current interrupting fuse element portion, and each sleeve includes a first end adjacent the first connector and a second end adjacent the high current limiting fuse element portions. The low current interrupting fuse element portion includes a weak spot located adjacent to but within the second end of a respective one of the sleeves. Alternatively, the weak spot is located in a range from 0 to 25% of the length of the sleeve as measured from the second end of the sleeve.

By locating the weak spot of the low current interrupting fuse element at an end of the insulating sleeve opposite the connector from which the low current interrupting fuse elements extend, ionized gas blasts generated in operation of a fuse is directed predominately toward a center of the fuse rather then the ends of the fuse near the end-caps. Therefore, by more efficiently and effectively expelling ionized gas from the insulative sleeve, the fuse element assembly avoids damage to the fuse body and end-caps that has been observed in conventional fuses, and higher voltage and current ratings are facilitated without increasing dimensions of fuse components. Thus, a superior performing Full-Range fuse is provided in a compact, space-saving construction in comparison to known Full-Range fuses.

DETAILED DESCRIPTION OF THE INVENTION

Figure 1:
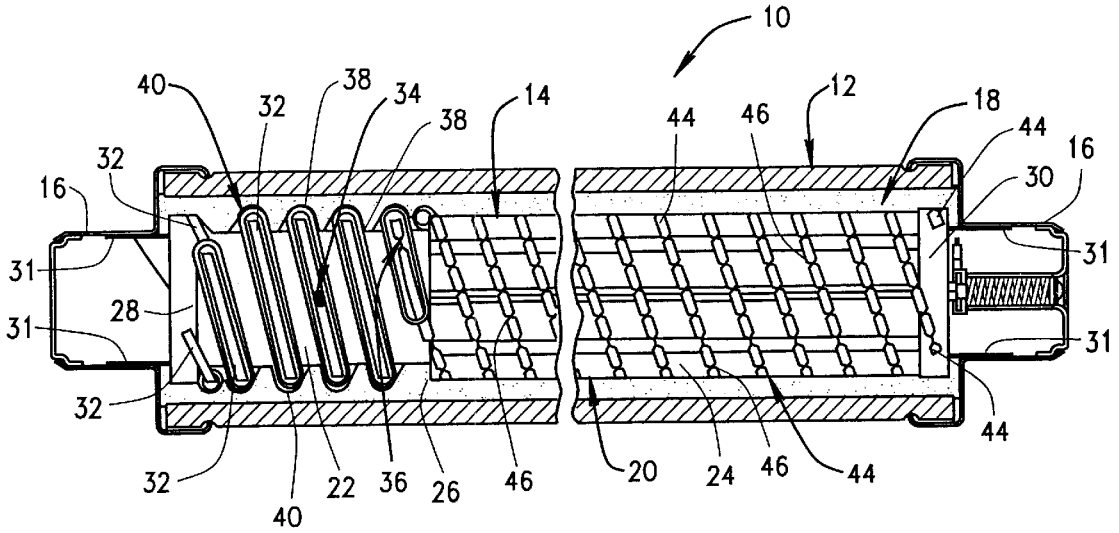
FIG. 1 is sectional schematic of a first embodiment of a Full-Range fuse.

FIG. 1 illustrates a Full-Range fuse 10 including an insulative fuse body 12, a fuse element assembly 14 within body 12, electrically conductive end-caps 16 coupled to and enclosing body 12 and electrically connected to fuse element assembly 14, and an arc quenching material 18 surrounding fuse element assembly 14 within body 12. Thus, when end-caps 16 are connected to an energized electrical circuit (not shown), a circuit is completed through fuse 10 via fuse element assembly 14. When current flowing through fuse 10 approaches unacceptable levels, dependent upon characteristics of fuse element assembly 14 and hence the current rating of fuse 10, fuse element assembly 14 at least partially operates, melts, vaporizes or otherwise opens, as explained more fully below, to limit current flow and interrupt damaging current flow through fuse 10. Thus, line-side electrical circuits and equipment may be electrically isolated from malfunctioning load-side electrical circuits and equipment to prevent costly damage to the load and line-side circuits and equipment.

In one embodiment, body 12 is fabricated from a known insulative, i.e., non-conductive material, such as ceramic materials, and extends substantially cylindrically between end-caps 16. It is contemplated, however, that the benefits of the invention may be realized in fuses employing non-cylindrical bodies and fabricated from other materials. In addition, in an exemplary embodiment arc extinguishing medium 18 is granular pure silica sand or powdered quartz that completely surrounds fuse element assembly 14 and substantially eliminates air gaps around fuse element assembly 14 within body 12. In alternative, embodiments, however, other known arc extinguishing materials and mediums are employed in fuse 10 in lieu of pure silica sand or powdered quartz.

Fuse element assembly 14 includes an insulated former 20 having a first portion 22 and a second portion 24 having a greater relative cross sectional area than first portion 22. More specifically, in an exemplary embodiment, former 20 is integrally formed and extends substantially cylindrically with a step increase 26 in diameter that delineates former first portion 22 and former second portion 24 into relatively narrow and relatively wide portions, respectively. In alternative embodiments, however, separate narrow and wide portions 22 and 24 are secured to one another in fabrication of former 20. In addition, it is contemplated that the benefits of the invention may be realized using alternative shapes, i.e., non cylindrical shapes, of former 22, including but not limited to elliptical cross-sectional shapes, polygonal, ribbed or star cross-sectional shapes. Still further, it will be apparent further below that the invention may be employed on a former 22 having a substantially constant or uniform cross-sectional area, although it is noted that a substantially non-uniform clearance between fuse element assembly 14 and body 12 may result unless body 12 is modified accordingly.

Electrically conductive connectors 28, 30 are oppositely coupled to former 20 at either end of former 20, i.e., at respective ends of former first portion 22 and former second portion 24 located away from step diameter increase 26. Each connector 28, 30 may include extensions 31 that establish electrical contact with end-caps 16. Thus, an electrical circuit may be established through fuse elements, explained further below, that are wound about former 20 and electrically coupled to connectors 28, 30.

A plurality of low current interrupting fuse elements 32 are wound about former first portion 22 and extend longitudinally from connector 28 toward former step increase 26 in a helical fashion. Each low current interrupting fuse element 32 is fabricated from a relatively low-melting point alloy or metal such as tin, or alternatively, for example, from a silver or copper element having an M effect overlay (low melting alloy spot) 34 or M spot thereon and located intermediate connector 28 and former step diameter increase 26.

More specifically, in an exemplary embodiment, each low current interrupting fuse element 32 is at least partially coated with an overlay 34 of a conductive metal that is different from a composition of fuse element 32. In one illustrative embodiment, for example, fuse elements 32 are fabricated from copper or silver and overlay 34 is fabricated from tin. As tin has a lower melting temperature than copper or silver, overlay 34 is heated to a melting temperature in an overcurrent condition before copper fuse element 32. The melted overly then reacts with copper or silver fuse element 32 and forms a tin-copper alloy that has a lower melting temperature than either metal by itself. As such, an operating temperature of fuse element 32 is lowered in an overcurrent condition, and each fuse element 32 is prevented from reaching the higher melting point of silver or copper. Thus, conductive characteristics and advantages of copper or silver are utilized while avoiding undesirable operating temperatures. In alternative embodiments, other conductive materials may be used to fabricate fuse elements 32 and overlay 34, including but not limited to copper and silver alloys and tin alloys, respectively, to achieve similar benefits. In further alternative embodiments, overlay 34 is fabricated from antimony or indium.

Overlay 34 is applied to respective fuse elements 32 using known techniques, including for example, gas flame and soldering techniques. Alternatively, other methods, including but not limited to electrolytic plating baths, thin film deposition techniques, and vapor deposition processes may be employed. Using these techniques, in various embodiments overlay 34 is applied to some or all of fuse elements 32. For example, in one embodiment, only a central portion of a fuse element 32 includes overlay 34, while in another embodiment, an entire surface area of a fuse element 32 includes overlay 34. In a further embodiment, overlay 34 is applied on one side only of a fuse element 32, while in a different embodiment, both sides of a fuse element 32 include M effect overlay 34.

Each low current interrupting fuse element 32 further includes a narrowed portion, or weak spot 36, of reduced cross sectional area in which fuse element 32 is designed to melt, open, or otherwise break an electrical connection through fuse 10. Because of the reduced cross-sectional area of weak spot 36 relative to a remainder of fuse element 32, weak spot 36 is heated to a higher temperature as current flows therethrough than through a remainder of fuse element 32, and hence reaches the melting point of fuse element 32 before the remainder of fuse element 32. Thus, fuse element 32 predictably opens in the area of weak spot 36 before other portions of fuse element 32. It will be appreciated by those in the art that weak spots 36 could alternatively be formed according to other known methods and techniques known in the art, such as, for example, forming holes in fuse elements 32 rather than narrowed regions.

Each low current interrupting fuse element 32 is further encased in a flexible thermally insulative sleeve 38 of slightly greater dimension than a width of each fuse element 32. Insulative sleeves 38 are fabricated from materials capable of withstanding high temperatures when fuse 10 is operated and also has a sufficient electrical resistance for insulative purposes. In an exemplary embodiment, sleeves 38 are fabricated from silicon rubber. In alternative embodiments, other known materials are used in lieu of silicone rubber for fabricating sleeves 38. In further embodiments, inserts (not shown) of, for example, silicon grease, are positioned in respective ends of open sleeves 38 adjacent connector 28 and former step diameter increase 26 to prevent arc extinguishing medium 18 from entering sleeves 38, yet while allowing ionized gas to escape sleeves 38 as fuse 10 is operated.

Notably, and unlike conventional Full-Range fuses, weak spot 36 of each low current interrupting fuse element 32 is located proximally to step diameter increase 26 of fuse assembly former 14, or toward a center of fuse 10. In other words, in one embodiment weak spots 36 of low current interrupting fuse elements 32 are located, to the extent possible, as far away from connector 18 and end-cap 16 as is practicable but still within respective sleeves 38. As fuse elements 32 open near weak spots 36, an electrical arc is generated across the break in weak spot 36 within sleeves 38. The resultant blast of ionized gas is expelled from sleeve 38 predominately through the closer end of sleeve 38 located opposite from connector 28 and toward a center of fuse 10, i.e., proximal to former step diameter increase 26 in the illustrated embodiment. Therefore, only a small portion of ionized gas travels through sleeves 38 to their ends adjacent connector 28, and excessive exhaust pressure generated in sleeves 38 is primarily, and harmlessly, dissipated in arc extinguishing medium 18 surrounding fuse element assembly 14 away from connector 28 and end-cap 16, or adjacent former step diameter increase 26 in the illustrated embodiment. Only a small portion of exhaust pressure travels longitudinally through sleeves 38 and exits sleeves 38 adjacent connector 28 and end-cap 16. Thus, unlike known Full-Range fuses, increased energy of ionized gas blasts from elements 32 operating at higher currents, i.e., up to 100 A, and high voltages, i.e., 12 kV to 38 kV may be safely and effectively dissipated without rupturing fuse body 12 near end-cap 16 adjacent connector 28 and without damaging or displacing end-cap 16.

It is contemplated that the benefits of the invention could be attained in alternative embodiments by locating weak spot 36 of each low current interrupting fuse element 32 in a range of positions toward a center of fuse 10 and away from a central region of respective low current interrupting fuse elements 32. More specifically, some or all of the above-described advantages accrue to fuse elements 32 having weak spots 36 located up to about 25% of the total length of a sleeve 38 as measured from the end of the sleeve opposite connector 28, i.e., the end of a sleeve 38 located closest to the center of fuse 10.

In the illustrated embodiment, a reinforcing medium 40 is employed over insulating sleeves 38 to prevent damage to sleeves 38 from exhaust pressure in sleeves 38 when fuse 10 operates. In one embodiment, reinforcing medium is glass-fiber tape, although in alternative embodiments other known reinforcing media known in the art is employed to accomplish similar objectives. It is appreciated, however, that positioning weak spots 36 of each low current interrupting fuse element 32 away from connector 38 and toward a center of fuse 10 may obviate the need for reinforcing media 40 in certain fuse ratings by more efficiently dissipating exhaust pressure in sleeves 38 away from connector 28 and end-cap 16 where fuse 10 is less susceptible to damage, thereby simplifying manufacturing of fuse 10 and reducing manufacturing costs.

A plurality of high current limiting current fuse elements 44 are wound around former second portion 24 and are electrically coupled to connector 30 on an end of former 20 opposite connector 28. Each high current limiting fuse element 44 is fabricated from a relatively high-melting point material, such as silver or copper, and extends in a helical fashion from connector 30 toward step diameter increase 26 of fuse element assembly former 22. Each high current limiting fuse element is connected in parallel via connector 30 and includes a plurality of weak spots 46 or narrowed regions of reduced cross sectional area located at spaced intervals between connector 30 and low current interrupting fuse elements 32. It will be appreciated by those in the art that weak spots 46 could alternatively be formed according to other methods and techniques known in the art, such as, for example, forming holes in fuse elements 44 rather than narrowed regions.

Each high current limiting fuse element 44 is coupled to a respective one of low current interrupting fuse elements 32 to form a plurality of continuously extending fuse elements that are partly high current limiting fuse elements 24 and partly low current interrupting fuse elements 32. The continuously extending fuse elements are wound about former 22 in a helical fashion and are connected in parallel with one another between connectors 28, 30.

In an alternative embodiment, low current interrupting fuse elements 32 and high current limiting fuse elements 44 are connected to an interconnector member (not shown) disposed between low current interrupting fuse elements 32 and high current limiting fuse elements 24 in the vicinity of former step diameter increase 26. As such, different numbers of low current interrupting fuse elements 32 relative to high current limiting fuse elements 44 may be employed to vary voltage and current ratings of fuse 10. As will be appreciated by those in the art, actual voltage and current ratings of fuse 10 may be further manipulated by altering dimensional characteristics of low current interrupting fuse elements 32 and high current limiting fuse elements 44.

Fuse 10 operates as follows. During low overcurrent conditions, e.g., less than six times the current ratings of fuse element assembly 14, high current limiting fuse elements 44 are cooled by arc extinguishing medium 18 and low current interrupting fuse elements 32 open at M spots 34 within sleeves 38. Low pressure ionized gas from resultant arcs is expelled from sleeves 38 at either end of sleeve 38 without damaging fuse body 12 or end cap 16 adjacent connector 28.

At higher current conditions just before the point where high current limiting elements 44 take over the duty of fault interruption, fuse elements 32 open at weak spots 36 within sleeves 38 due to temperature effects from thermally insulating sleeves 38 before M effect spots 34 have sufficient time to operate and interrupt current through fuse elements 32. The resultant arc when fuse elements 32 open at weak spots 36 is extinguished in sleeves 38 by the above-described expulsion process of ionized gas in sleeves 38. As gas is predominately dissipated harmlessly into arc quenching medium 18 toward the center of fuse 10 and away from connector 28 and end-cap 16, damaging effects of high exhaust pressure near connector 28 is avoided. With proper dimensioning of weak spots 36, it can be ensured that operation of fuse elements 32 occurs at weak spots 36 before opening of fuse element 32 in the vicinity of M spots 38 at predetermined current levels that approach current values sufficient to operate high current limiting fuse elements 44.

At even higher values of overload current, opening of fuse elements 32 at weak spot 36 and opening of fuse elements 44 at weak spots 46 occurs substantially simultaneously. Consequently, arc energy is dissipated in each of the single weak spots 36 of fuse elements 32. However, at such higher current, an even greater gas blast may be generated within sleeves 38. Thus, positioning of weak spot 36 of respective low current interrupting elements 32 closer to center of fuse and in the vicinity of former step diameter increase 26 if of greater significance to direct damaging gas blasts away from connector 28 at the end of fuse 10.

A fuse 10 is therefore provided that controls ionized gas blasts in sleeves 38 at a full range of fault currents, including takeover current values wherein current interrupting duty is transferred from low current interrupting fuse elements 32 to high current limiting fuse elements 44. Therefore, fuse 10 is capable of performing at higher voltage and current ratings than known Full-Range fuses. A much wider range of applications is therefore available for using fuse 10 due to controlled ionized gas blast in sleeves 38. For example, a Full-Range fuse 10 having a voltage rating of 10 kV and a current rating of 100 A may be used to protect a transformer of 1000 kVA or greater. Similarly, Full-Range fuses 10 having voltage ratings as high as 38 kV may be constructed.

In addition, by locating weak spots 36 of low current interrupting fuse elements 32 at an end of insulating sleeves 38 opposite connector 28 and therefore directing ionized gas blasts predominately toward a center of fuse 10 rather then the ends of fuse 10, fuse 10 is capable of attaining higher voltage and current ratings without increasing dimensions of fuse components. Thus, a superior performing Full-Range fuse 10 is provided in a compact, space-saving construction in comparison to known Full-Range fuses.

Figure 2:
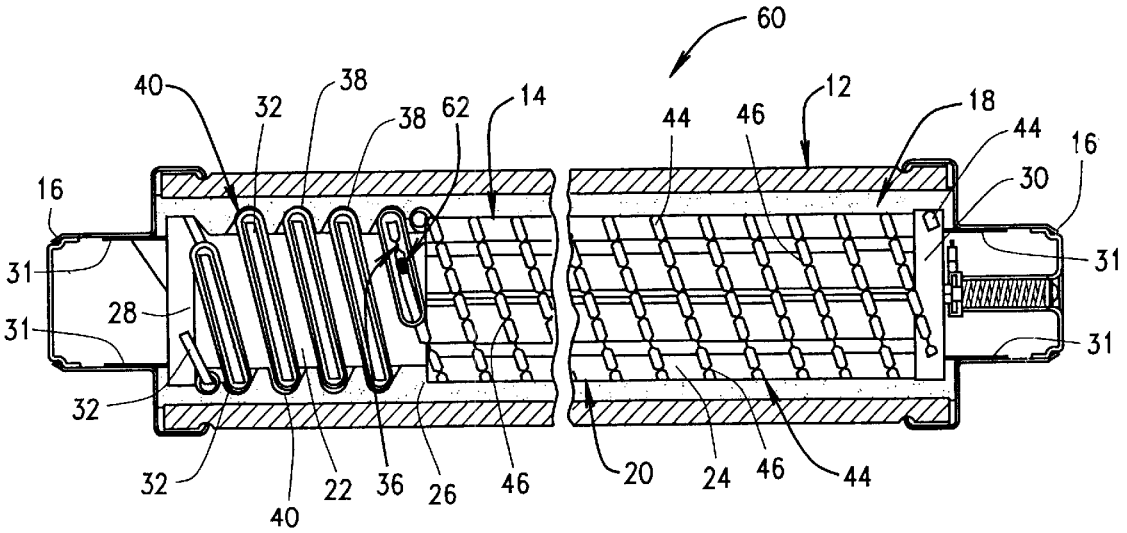
FIG. 2 is a sectional schematic of a second embodiment of a Full-Range fuse.

FIG. 2 is a sectional schematic of a second embodiment of a Full-Range fuse 60 wherein common features with fuse 10 (shown in FIG. 1 and described above) are indicated with like reference characters. Comparing fuse 10 and fuse 60, it may be seen that fuse 60 includes an M spot 62 located proximally to weak spot 36 of each low current interrupting fuse element 32, as opposed to M spot 34 (shown in FIG. 1) located in a central portion of each fuse element 32. Therefore, in addition to the benefits described above when fuse elements 32 open at weak spots 36, ionized gas generated from operation of fuse elements 32 at M spots 34 also is harmlessly dissipated into arc extinguishing medium through sleeves 38 toward the center of fuse 60. Fuse 60 otherwise operates substantially as described above with respect to fuse 10, and the benefits described above in relation to FIG. 1 are also attained. Positioning of M spot 34 either in a center of respective sleeves 38 (as shown in FIG. 1) or proximal to weak spots 36 (as shown in FIG. 2) is dictated by thermal parameters of specific materials of the fuse components.

It is contemplated that the benefits of the invention could be achieved at lower fuse ratings using a single low current interrupting element 32 and a single high current limiting member 44. In addition, in alternative embodiments, low current interrupting elements 32 may employ more than weak spot 36 located toward a center of fuse 10 and away from a central region of fuse elements 32. Still further, in alternative embodiments, fuses are electrically connected to end-caps 16 without being helically wound about former 20, such as for example, by employing substantially linear fuse elements between end-caps 16, with or without former 20.

While the invention has been described in terms of various specific embodiments, those skilled in the art will recognize that the invention can be practiced with modification within the spirit and scope of the claims.

What is claimed is:

1. A fuse element assembly for a Full-Range fuse, said fuse element assembly comprising:

an insulative former comprising opposite first and second ends;

a first electrically conducting connector coupled to said former first end;

a second electrically conducting connector coupled to said former second end;

at least one fuse element extending between said first connector and said second connector about said insulative former, said at least one fuse element comprising a low current interrupting fuse element portion extending from said first connector, a high current limiting fuse element portion extending from said second connector, and said low current interrupting fuse element portion and said high current limiting fuse element portion coupled to one another intermediate said first and second connector; and an insulative sleeve surrounding said low current interrupting fuse element portion, said sleeve having a first end adjacent said first connector and a second end adjacent said high current limiting fuse element portion, said low current interrupting fuse element portion comprising a weak spot located adjacent said second end of said sleeve.

2. A fuse element assembly in accordance with claim 1, said former comprising a first portion having a first cross-sectional area and a second portion having a second cross sectional area, said second cross sectional area greater than said first cross sectional area.

3. A fuse element assembly in accordance with claim 2, said former further comprising a step increase in cross sectional area between said former first portion and said former second portion.

4. A fuse element assembly in accordance with claim 3 wherein said at least one fuse element extends helically about said former.

5. A fuse element assembly in accordance with claim 1 comprising a plurality of fuse elements, said plurality of fuse elements are connected in parallel.

6. A fuse element assembly in accordance with claim 1 wherein said low current interrupting fuse element portion further comprises an M effect overlay.

7. A fuse element assembly in accordance with claim 6 wherein said M effect overlay is located adjacent said weak spot of each low current interrupting fuse element portion.

8. A fuse element assembly for a Full-Range fuse, said fuse element assembly comprising:

an insulative former comprising opposite first and second ends;

a first electrically conducting connector coupled to said former first end;

a second electrically conducting connector coupled to said former second end;

a plurality of low current interrupting fuse elements extending from said first connector toward said second connector;

each of said low current interrupting fuse elements comprising a weak spot therein;

a plurality of said high current limiting fuse elements extending from said second connector toward said first connector, each of said high current limiting fuse element portions comprising a plurality of weak spots, said low current interrupting fuse element portions and said high current limiting fuse element portions coupled to one another intermediate said first and second connectors; and a plurality of insulative sleeves each surrounding one of said low current interrupting fuse element portions, said sleeves each having a first end adjacent said first connector and a second end opposite said first end, said second end of each sleeve located proximally to a respective said weak spot of a respective one of said low current interrupting fuse elements.

9. A fuse element assembly in accordance with claim 8 wherein each of said low current interrupting fuse elements are connected in parallel.

10. A fuse element assembly in accordance with claim 9 wherein each of said low current interrupting fuse elements extends helically about said former.

11. A fuse element assembly in accordance with claim 8 wherein said former comprises a first portion, a second portion, and a step increase intermediate said first portion and said second portion, said second end of said sleeve positioned adjacent said step increase.

12. A fuse element assembly in accordance with claim 8 wherein each of said low current interrupting fuse elements comprises an M effect overlay.

13. A fuse element assembly in accordance with claim 12 wherein said M effect overlay is located adjacent said weak spot on each of said low current interrupting fuse elements.

* * * * *